US008550047B2

(12) United States Patent
Odell et al.

(10) Patent No.: US 8,550,047 B2
(45) Date of Patent: Oct. 8, 2013

(54) VALVE CONTROL APPARATUS FOR INTERNAL COMBUSTION ENGINE

(75) Inventors: Marcus Odell, Plain City, OH (US); Masataka Ikawa, Tochigi (JP); Yuji Matsumochi, Tochigi (JP); Akira Terao, Powell, OH (US); Yasutaka Hayashi, Sakura (JP)

(73) Assignee: Honda Motor Co., Ltd., Tokyo (JP)

( * ) Notice: Subject to any disclaimer, the term of this patent is extended or adjusted under 35 U.S.C. 154(b) by 509 days.

(21) Appl. No.: 12/792,407

(22) Filed: Jun. 2, 2010

(65) Prior Publication Data

US 2010/0307434 A1 Dec. 9, 2010

(51) Int. Cl.
*F01L 1/18* (2006.01)

(52) U.S. Cl.
USPC ..... 123/90.39; 123/90.16; 123/90.44; 74/569

(58) Field of Classification Search
USPC ..... 123/90.39, 90.44, 90.16; 74/567, 74/569
See application file for complete search history.

(56) References Cited

U.S. PATENT DOCUMENTS

| | | | |
|---|---|---|---|
| 1,267,337 | A | 5/1918 | Huebotter |
| 2,374,958 | A | 5/1945 | Hibner et al. |
| 3,316,715 | A | 5/1967 | McFarland |
| 3,783,962 | A | 1/1974 | Shaffer et al. |
| 4,887,563 | A | 12/1989 | Ishida et al. |
| 4,907,550 | A | 3/1990 | Inoue et al. |
| 5,357,917 | A | 10/1994 | Everts |
| 5,706,769 | A | 1/1998 | Shimizu |
| 5,884,593 | A | 3/1999 | Immel et al. |
| 6,210,129 | B1 | 4/2001 | Stiefel |
| 6,216,655 | B1 | 4/2001 | Yoshiki et al. |
| 6,349,688 | B1 | 2/2002 | Gracyalny et al. |
| 6,382,178 | B2 | 5/2002 | Higashi et al. |
| 6,481,397 | B2 | 11/2002 | Suzuki |
| 6,505,589 | B1 | 1/2003 | Hayman et al. |
| 6,588,387 | B2 | 7/2003 | Cecur |
| 6,769,387 | B2 | 8/2004 | Hayman et al. |
| 6,810,844 | B2 * | 11/2004 | Sellnau ..... 123/90.16 |
| 6,899,065 | B2 | 5/2005 | Hauser |
| 6,901,894 | B2 | 6/2005 | Haas et al. |

(Continued)

FOREIGN PATENT DOCUMENTS

JP 61160508 7/1986

OTHER PUBLICATIONS

International Search Report of PCT/US2011/034958 dated Aug. 18, 2011.
Written Opinion of PCT/US2011/034958 dated Aug. 18, 2011.

*Primary Examiner* — Ching Chang
(74) *Attorney, Agent, or Firm* — Rankin Hill & Clark LLP

(57) ABSTRACT

A valve control synchronizing apparatus for an internal combustion engine for controlling opening and closing operations of an engine valve includes a synchronizing pin assembly selectively transferring pivoting movement from one or both of first and second adjacent rocker arms to a central rocker arm. The synchronizing pin assembly is received in a bore defined through the central rocker arm and at least partially into each of the first and second rocker arms. The synchronizing pin assembly bridges between the first rocker arm and the central rocker arm to transfer pivoting movement of the first rocker arm to the central rocker arm and bridges between the second rocker arm and the central rocker arm to transfer pivoting movement from the second rocker arm to the central rocker arm.

24 Claims, 10 Drawing Sheets

(56) References Cited

U.S. PATENT DOCUMENTS

| | | | | |
|---|---|---|---|---|
| 6,948,466 | B2 | 9/2005 | Haas et al. | |
| 6,955,144 | B2 | 10/2005 | Sakai et al. | |
| 6,968,819 | B2 | 11/2005 | Fujii et al. | |
| 7,231,998 | B1 | 6/2007 | Schechter | |
| 7,421,981 | B2 * | 9/2008 | Wakeman | 123/21 |

* cited by examiner

| 110 | POTENTIAL 3-WAY ROCKER ARM CAM PROFILE OPTIONS | | |
|---|---|---|---|
| | ROCKER (20) | MID ROCKER (14) | ROCKER (18) |
| TYPE 1 | HI RPM | OFF | LO RPM |
| TYPE 2 | HI RPM | LO RPM | LATE CLOSE |
| TYPE 3 | HI RPM | EARLY CLOSE | LO RPM |

112

114

VALVE CONTROL APPARATUS FOR INTERNAL COMBUSTION ENGINE

BACKGROUND

The present disclosure relates to a valve control apparatus for an internal combustion engine, and particularly relates to a valve control apparatus for controlling engine valve opening and closing operations in an internal combustor engine.

Internal combustion engines conventionally rely on poppet valves to regulate the supply of feed gas and expulsion of exhaust gas from cylinders of the engine. In particular, one or more intake valves regulate the supply of feed gas into a particular cylinder and one or more exhaust valves regulate the expulsion of exhaust gas from the same cylinder. Opening and closing of these valves are operated or controlled through rocker arms. More particularly, the intake and exhaust valves are normally maintained in a closed position by a biasing mechanism, such as conventional valve springs, and opened against the urging of the springs by a pivoting rocker arm imparting linear movement to the intake and exhaust valves.

In one arrangement, the rocker arms act as cam followers and transfer motion of a cam disposed on a rotating cam shaft to the valve. A cam can have a particular cam profile that is designed to open the valve such that the valve follows a desired opening and closing pattern. Traditionally, a single cam having a single cam profile operates one or more valves. An advancement over this traditional arrangement employs two or more rocker arms following two or more cam profiles for a particular valve or set of valves. In this advanced arrangement, the rocker arms for a particular valve or set of valves follow different cam profiles having particular optimized performance characteristics. For example, a cam associated with a particular rocker arm can have a profile designed to optimize engine performance when the engine is in a low RPM state or alternatively a high RPM state. The cam profile can also be designed to operate the engine in a high power mode or a high fuel efficiency mode. Multiple rocker arm systems, such as the foregoing, have been used to increase the power density (kW/L) of the engine, which can also allow for a smaller engine producing the same power. One such exemplary valve operating apparatus is described in commonly assigned U.S. Pat. No. 4,887,563, expressly incorporated herein by reference.

A variation on this technology allows for the valve motion (i.e., opening and closing) to be substantially deactivated, such as might be desirable when reducing the number of active cylinders during engine operation. Cylinder deactivation has been widely employed to temporarily decrease the number of operating cylinders in a multi-cylinder internal combustion engine to improve the engine's overall efficiency, particularly at light loads. This arrangement can include two rocker arms associated with a particular valve or set of valves. One of the rocker arms can connect to the particular valve or set of valves, while the other rocker arm can connect to a desired cam profile. A synchronizing pin having a longitudinal axis parallel to the rocker arms' rotating axis can connect and disconnect the rocker arms to and from one another. This allows the valve or set of valves to be actively following a cam profile or inactive, following no cam profile. Such synchronizing pins are pushed into and out of pairs of rocker arms by oil pressure supplied in changing paths. The synchronizing pins are limited to two positions, including a first position when oil pressure is low and a second position when oil pressure is high.

The number of rocker arms associated with a particular valve or set of valves, the number of rocker arms that can be connected together by synchronizing pins, and/or the number of synchronizing pins used in association with a particular valve or set of valves is sometimes limited. In particular, these can be limited due to size, weight and/or cost considerations. Competing considerations in engine design include downsizing the engine to improve fuel economy and increasing the amount of power generated by the engine. In addition, if three or more valve lift patterns are desired in an engine for one or more engine valves of a particular cylinder, several problems occur that potentially reduce performance of the engine. For example, to guarantee that the right valve lift pattern can be quickly chosen, all rocker arms must be connected during high engine RPM. The reciprocating mass of such a system of rocker arms becomes undesirably large.

BRIEF DESCRIPTION

According to one aspect, a valve control apparatus for an internal combustion engine is provided for controlling opening and closing operations of the engine valve. More particularly, in accordance with this aspect, the valve control apparatus includes a central rocker arm, a first adjacent rocker arm and a second adjacent rocker arm. The central rocker arm is pivotally supported on a rocker shaft. Pivoting movement of a central rocker arm imparts linear movement to the engine valve for opening and closing the engine valve. The first adjacent rocker arm is pivotally supported on the rocker shaft on a first side of the central rocker arm. The second adjacent rocker arm is pivotally supported on the rocker shaft on a second, opposite side of the central rocker arm.

A plurality of cams are rotatably driven in synchronism with rotation of the engine. The plurality of cams include a first cam arranged to pivotally move the first adjacent rocker arm about the rocker shaft according to a first cam profile of the first cam and a second cam arranged to pivotally move the second adjacent rocker arm about the rocker shaft according to a second cam profile of the second cam. The valve control apparatus further includes a dual synchronizing pin for selectively synchronizing pivoting movement of the central rocker arm to at least one of the first adjacent rocker arm and the second adjacent rocker arm. The dual synchronizing pin has a first state wherein pivotal movement of the first adjacent rocker arm, which corresponds to the first cam, is transferred to the central rocker arm, a second state wherein pivotal movement of the second adjacent rocker arm, which corresponds to the second cam, is transferred to the central rocker arm, and a third state wherein no pivotal movement is transferred from either the first adjacent rocker arm or the second adjacent rocker arm.

According to another aspect, a valve control apparatus for an internal combustion engine is provided for controlling engine valve opening and closing operations. In this apparatus, a central rocker arm is pivotally supported for imparting linear movement to at least one first engine valve. Movement of the central rocker arm is directed a cam having a cam surface. A first rocker arm is pivotally supported adjacent a first side of said central rocker arm for imparting linear movement to at least one second engine valve. Movement of the first rocker arm is directed by the cam having the cam surface. A second rocker arm is pivotally supported adjacent a second, opposite side of the central rocker arm for imparting linear movement to at least one third engine valve. Movement of the second rocker arm is directed by the cam having the cam surface.

According to still another aspect, a valve control apparatus for an internal combustion engine is provided for controlling engine valve opening and closing operations. In this apparatus, a central rocker arm is pivotally supported for imparting linear movement to at least one engine valve. A first rocker arm is pivotally supported adjacent a first side of the central rocker arm for imparting linear movement to the at least one engine valve. A second rocker arm is pivotally supported adjacent a second, opposite side of the central rocker arm for imparting linear movement to said at least one engine valve.

According to still another aspect, a method is provided for synchronizing rocker arms of an engine valve in an internal combustion engine. In the method, a central rocker arm flanked by two adjacent rocker arms is provided for imparting linear movement to the engine valve. The engine valve is moved according to pivotal movement of the central rocker arm. Pivotal movement from one of the adjacent rocker arms is selectively transferred to the central rocker arm through a synchronizing pin. Pivotal movement from the other of the adjacent rocker arms is selectively transferred to the central rocker arm through the synchronizing pin.

According to a further aspect, a three-way valve train system is provided that allows one or more valves of an engine cylinder to operate in three modes of operation. By way of example, these modes can include a normal mode, such as would be optimal for starting of the engine and low RPM acceleration of the engine; a high power mode, such as would be optimal for generating maximum power from the engine; and a deactivated mode of the type where one or more cylinders of the engine are deactivated by substantially closing the valves thereto for saving fuel.

According to still a further aspect, a valve train synchronizing pin is provided that allows for three positions. The synchronizing pin can include two or more sub pins which enable the synchronizing pin to selectively vary in axial length. The varying length of the synchronizing pin is used to selectively couple adjacent rocker arms together for synchronous movement.

DETAILED DESCRIPTION

Figure 1:
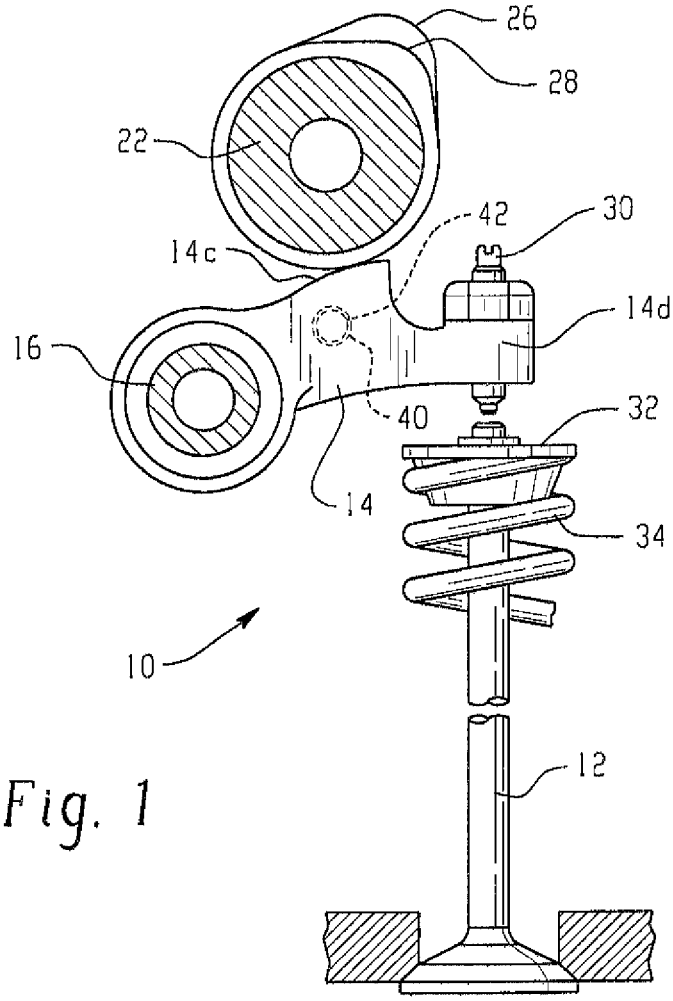
FIG. 1 is an elevational view, partially in cross section, illustrating a valve control apparatus for controlling opening and closing operations of an engine valve.
Figure 2:
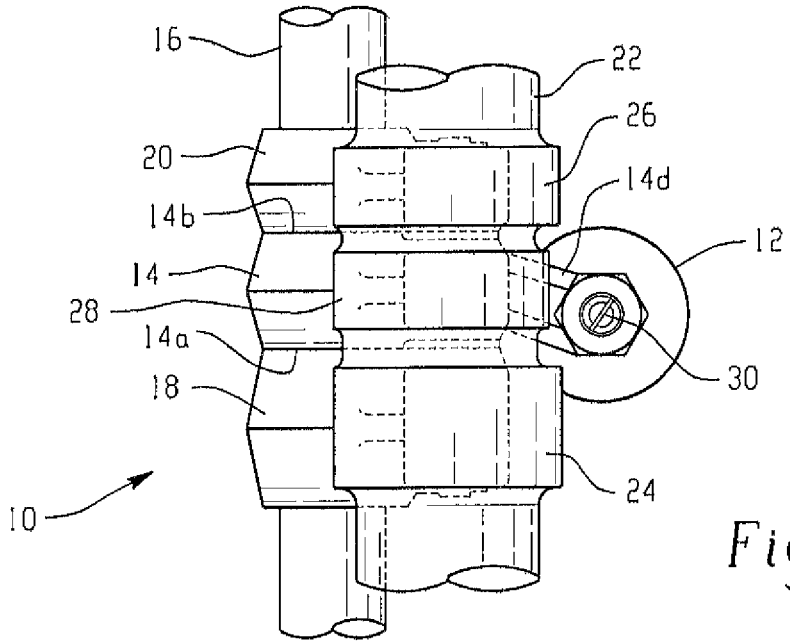
FIG. 2 is a partial plan view of the valve operating apparatus of FIG. 1 showing rocker arms and corresponding cams for the engine valve.

Referring now the drawings, wherein the showings are only for purposes of illustrating one or more exemplary embodiments and not for purposes of limiting same, FIGS. 1 and 2 illustrate a valve control synchronizing apparatus 10 for an internal combustion engine for controlling opening and closing operations of an engine valve 12. As best shown in FIG. 2, the control apparatus 10, which is also referred to herein as a valve train system, includes a central rocker arm 14 pivotally supported on a rocker shaft 16 for imparting linear movement to the engine valve 12. That is, pivoting movement of the central rocker arm 14 imparts linear movement to the engine valve 12 for opening and closing thereof. A first adjacent rocker arm 18 is pivotally supported adjacent a first side 14*a* of the central rocker arm 14 and a second adjacent rocker arm 20 is pivotally supported on the rocker shaft 16 adjacent an opposite side 14*b* of the central rocker arm 14.

The apparatus 10 further includes a cam shaft 22 rotatably disposed above the engine body. The cam shaft 22 is rotatable in synchronism with rotation of the engine, such as at a speed ratio of one half with respect to the speed of rotation of the engine. The cam shaft 22 is rotatably fixed in position above the rocker shaft 16. A plurality of cams (e.g., cams 24, 26, 28) can be disposed on the cam shaft 22 so as to be rotatably driven in synchronism with rotation of the engine via rotation of the cam shaft 22. In the illustrated embodiment, the plurality of cams includes first cam 24 arranged to pivotally move the first adjacent rocker arm 18 about the rocker shaft 16 according to a first cam profile of the first cam 24 and a second cam 26 arranged to pivotally move the second adjacent rocker arm 20 about the rocker shaft 16 according to a second cam profile of the second cam 26. Optionally, a third cam 28 can be arranged to pivotally move the central rocker arm 14 about the rocker shaft 16 according to a third cam profile of the third cam 28.

The cam shaft 22 is rotatably driven by the engine to rotate the cams 24, 26, 28 in synchronism with the engine. Respective engagement between the cams 24, 26, 28 and the rocker arms 14, 18, 20 respectively aligned therewith transfer rotational movement of the cam shaft 22 into pivoting movement of the rocker arms 14, 18, 20 about the rocker shaft 16. Accordingly, the rocker arms 14, 18, 20 are pivotally supported as cam followers on the rocker shaft 16 parallel to the cam shaft 22 and are selectively driven by the respective cams 24, 26, 28. As such, movement of the first adjacent rocker arm 18 is directed by the first cam 24 having the first cam profile and movement of the second adjacent rocker arm 20 is directed by the second cam 26 having the second cam profile. When the third cam 28 is included, movement of the central rocker arm 14 is normally directed by the third cam having the third cam profile.

In the embodiment illustrated in FIGS. 1 and 2, engine valve 12 is directly opened and allowed to close by the central rocker arm 14, which is axially aligned with the third cam 28. First adjacent rocker arm 18 is axially aligned with the first cam 24 and second adjacent rocker arm 20 is axially aligned with the second cam 26. As is known and understood by those skilled in the art, the rocker arms 14, 18, 20 can each have respective cam followers (e.g., cam follower 14*c* in FIG. 1) that are held in sliding contact with the cams 24, 26, 28, respectively. The central rocker arm 14 extends to a position above the engine valve 12. As shown, a tappet screw 30 can be threaded through a distal end of the central rocker arm 14 and arranged to engage the upper end of the engine valve 12. A retainer 32 can be attached to the upper end of the engine valve 12. The valve 12 is normally urged in a closing direction (i.e., upwardly in FIG. 1) by valve spring 34 disposed between a retainer 32 and a portion of the engine body (not shown). The valve 12 is moved to an open position by the central rocker 14 driving the valve 12 in an opening direction (i.e., downwardly in FIG. 1) and overcoming the urging of the valve spring 34. As is known and understood by those skilled in the art, lifters (not shown) can be employed to urge or hold the rocker arms 14, 18, 20 in sliding contact with their respective cams 24, 26, 28 and/or rollers 36 (FIG. 3) can be provided on the rocker arms 14,18,20 for smooth engagement with the cams 24,26,28.

Figure 3:
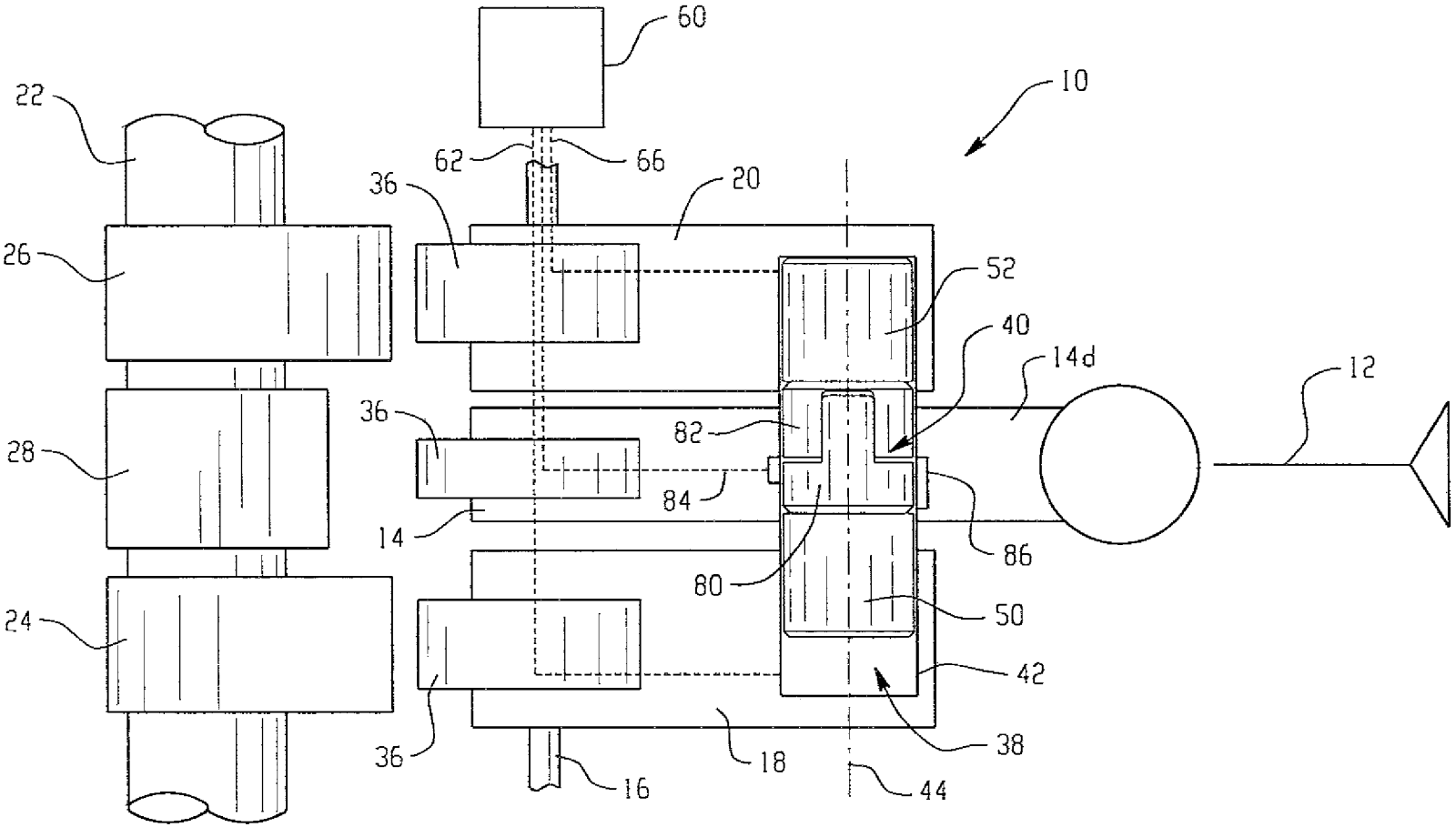
FIG. 3 is a schematic view of a valve operating apparatus similar to that of FIGS. 1 and 2 showing a dual synchronizing pin for selectively synchronizing pivoting movement of the rocker arms.

In the illustrated embodiment of FIGS. 1-3, a distal end of the central rocker arm 14 imparts linear opening movement to the engine valve 12 as described above. While this illustrated embodiment shows only a single engine valve 12 being operated by the central rocker 14, it is to be appreciated that the central rocker arm 14 could operate any number of engine valves 12. For example, the distal end of the central rocker arm 14 could have a Y-shaped configuration with a pair of spaced apart legs for operating two engine valves.

With additional reference to FIG. 3, the valve control apparatus 10 additionally includes a dual synchronizing pin assembly 38 including a dual synchronizing pin 40 for selectively synchronizing pivoting movement of the central rocker arm 14 to at least one of the first adjacent rocker arm 18 and the second adjacent rocker arm 20 (i.e., selectively transferring pivoting movement of one or both of the first and second adjacent rocker arms 18, 20 to the central rocker arm 14). As will be described in more detail below, the synchronizing pin assembly 38, including the synchronizing pin 40, is received in a bore 42 defined through the central rocker arm 14 and at least partially into each of the first and second rocker arms 18, 20. The dual synchronizing pin assembly 38 and the dual synchronizing pin 40, which can alternatively be referred to as a selective coupling, have a first state wherein pivotal movement of the first adjacent rocker arm 18, which corresponds to the first cam 24, is transferred to the central rocker arm 14. In the first state, the synchronizing pin assembly 38 bridges between the first adjacent rocker arm 18 and the central rocker arm 14 to transfer pivoting movement of the first rocker arm 18 to the central rocker arm 14. The dual synchronizing pin assembly 38 and the dual synchronizing pin 40 also have a second state wherein pivotal movement of the second adjacent rocker arm 20, which corresponds to the second cam 26, is transferred to the central rocker arm 14 by the synchronizing pin assembly 38 bridging between the second adjacent rocker arm 20 and the central rocker arm 14 to transfer pivoting movement from the second adjacent rocker arm 20 to the central rocker arm 14. Optionally, the dual synchronizing assembly 38 and pin 40 also can have a third state wherein no pivotal movement is transferred from either the first adjacent rocker arm 18 or the second adjacent rocker arm 20.

The synchronizing pin 40 of the illustrated embodiment has an adjustable axial length for selectively bridging or allowing bridging between the first adjacent rocker arm 18 and the central rocker arm 14, selectively bridging or allowing bridging between the second adjacent rocker arm 20 and the central rocker arm 14. In particular, the synchronizing pin 40 is movably disposed within the bore 42 defined in the rocker arms 14, 18, 20 for selectively connecting the central rocker arm 14 to either the first adjacent rocker arm 18 or the second adjacent rocker arm 20. The bore 42 has an axis 44 oriented generally parallel to the rocker shaft 16 (and cam shaft 22) and movement of the synchronizing pin 40 within the bore 42 occurs along the axis 44 to selectively connect the central rocker arm 14 to either of the first adjacent rocker arm 18 for synchronized pivotal movement therewith or the second adjacent rocker arm 20 for synchronized pivotal movement therewith.

Figure 4A:
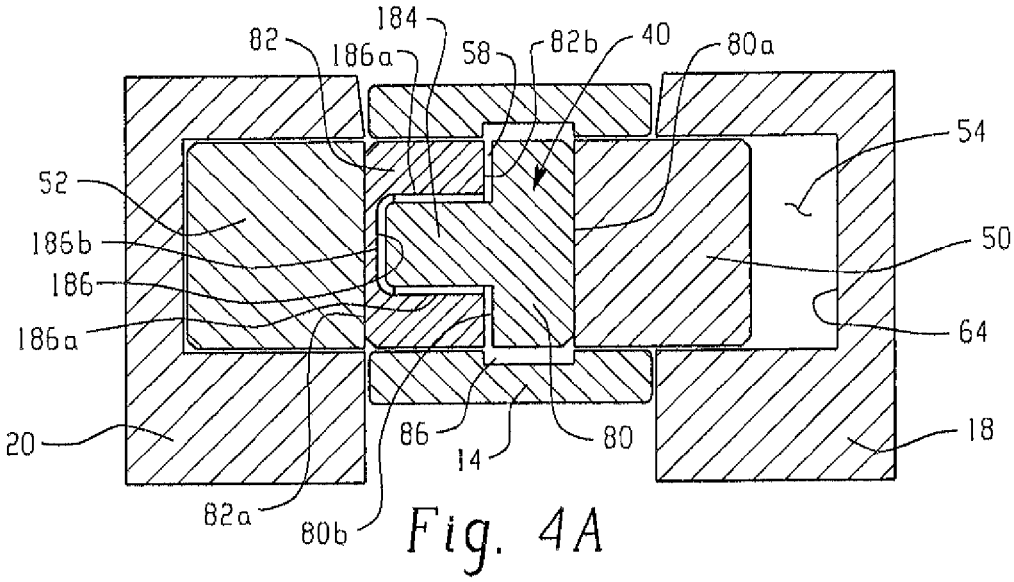
FIGS. 4A, 4B and 4C are schematic cross section views of the synchronizing pin of FIG. 3 in various operating states.
Figure 4B:
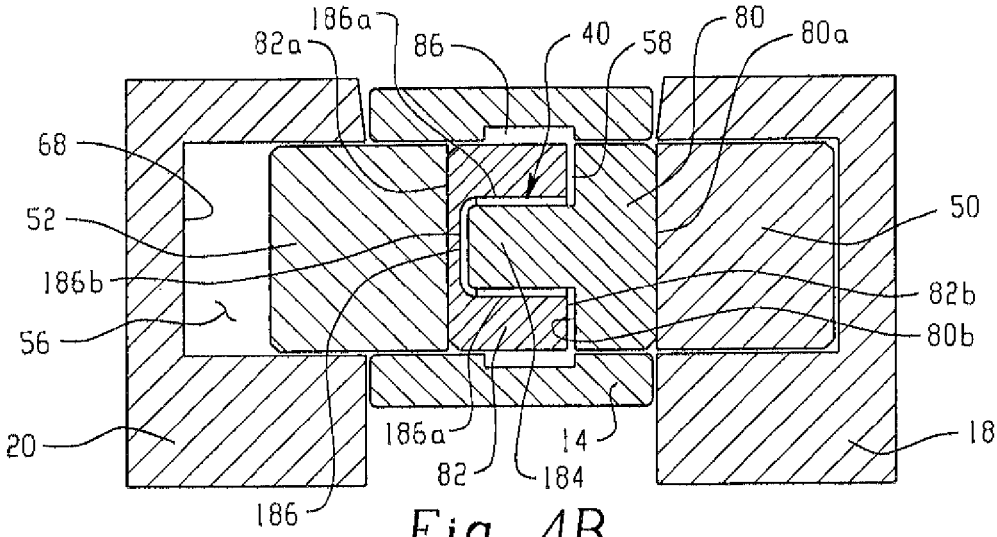

In the embodiment illustrated in FIG. 3, the dual synchronizing pin 40, which can also be referred to as a valve train synchronizing pin, is disposed between first and second auxiliary pins 50, 52 (i.e., the dual synchronizing pin assembly 38 of FIG. 3 including the dual synchronizing pin 40 and the auxiliary pins 50,52). More particularly, with additional reference to FIGS. 4A-4C and 5A-5C, the first auxiliary pin 50 is received with a first portion 54 of the bore 42 defined in the first adjacent rocker arm 18. The second auxiliary pin 52 is received within a second portion 56 of the bore 42 defined in the second adjacent rocker arm 20. The first auxiliary pin 50 is movable between an actuated or bridging position (FIGS. 4A and 5A) wherein the first auxiliary pin 50 is received in the first portion 54 and a third portion 58 of the bore 42 defined in the central rocker arm 14 to synchronize movement between the first adjacent rocker arm 18 and the central rocker arm 14 with one another and a non-actuated position (FIGS. 4B, 4C, 5B and 5C) wherein the first auxiliary pin 50 is received in the first portion 54 but removed from the third portion 58. Similarly, the second auxiliary pin 52 is movable between an actuated or bridging position (FIGS. 4B and 5B) wherein the second auxiliary pin 52 is received in the second portion 56 and the third portion 58 to synchronize movement of the second adjacent rocker arm 20 and the central rocker arm 14 with one another and a non-actuated position (FIGS. 4A, 4C, 5A and 5C) wherein the second auxiliary pin 52 is received in the second portion 56 but removed from the third portion 58.

The dual synchronizing pin 40 is received in the third portion 58 of the bore 42, which is defined through the central rocker arm in the illustrated embodiment. An axial length of the dual synchronizing pin 40 matches an axial length of the third portion 58 (FIGS. 4C and 5C) when the dual synchronizing pin 40 is in the third state to prevent the first and second auxiliary pins 50, 52 from protruding into the third portion 58 from the first and second portions 54, 56. The axial length of the dual synchronizing pin 40 is less than the axial length of the third portion 58 (FIGS. 4A, 5A and 4B, 5B) when the dual synchronizing pin 40 is in the first state (FIGS. 4A and 5A) to allow the first auxiliary pin 50 to extend into the third portion 58 (and bridge between the rocker arms 14,18) and when the dual synchronizing pin 40 is in the second state (FIGS. 4B and 5B) to allow the second auxiliary pin 52 to extend into the third portion 58 (and bridge between the rocker arms 18,20).

Pressurized hydraulic fluid from a hydraulic fluid pressure source 60 (schematically illustrated) selectively moves the first auxiliary pin 50, the second auxiliary pin 52 and the dual synchronizing pin 40 to change the dual synchronizing pin assembly 38 and the dual synchronizing pin 40 to one of the first, second, and third states. In particular, hydraulic fluid from the hydraulic fluid source 60 is forced along a schematically illustrated fluid passageway 62 into the first portion 54 of the first adjacent rocker arm 18 between the first auxiliary pin 50 and an end face 64 of the first adjacent rocker arm 18 defining the first portion 54 to move the first auxiliary pin 50 into the third portion 58 and thereby change the dual synchronizing pin assembly 38 and pin 40 into the first state of FIG. 4A. The pressure source 60 forces hydraulic fluid along a schematically illustrated fluid passageway 66 into a second portion 56 of the second adjacent rocker arm 20 between the second auxiliary pin 52 and an end face 68 of the second adjacent rocker arm 20 defining the second portion 56 to move the second auxiliary pin 52 into the third portion 58 and thereby change the dual synchronizing pin assembly 38 and pin 40 into the second state of FIG. 4B.

Figure 4C:
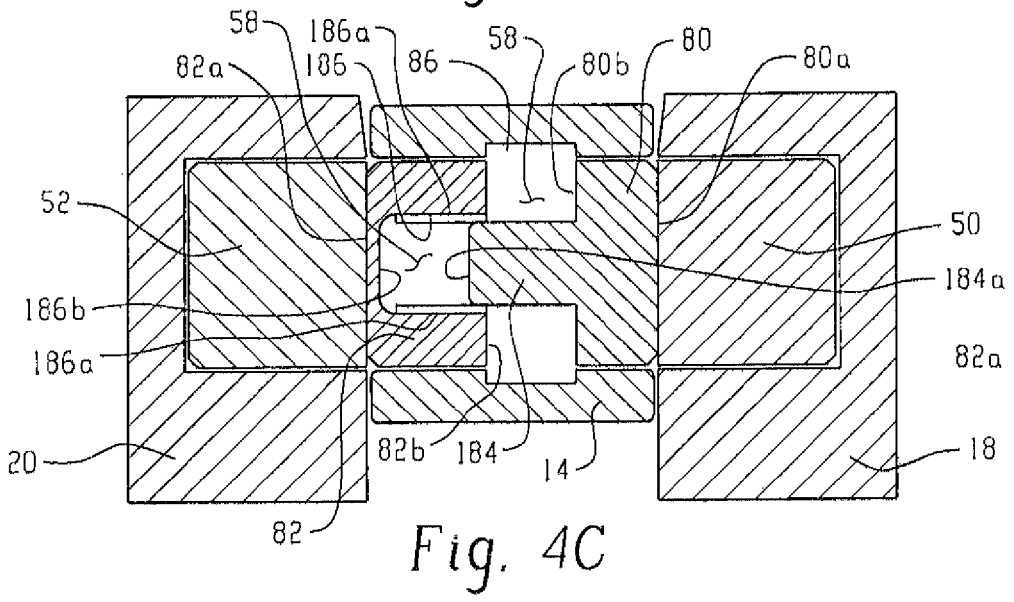
Figure 5A:
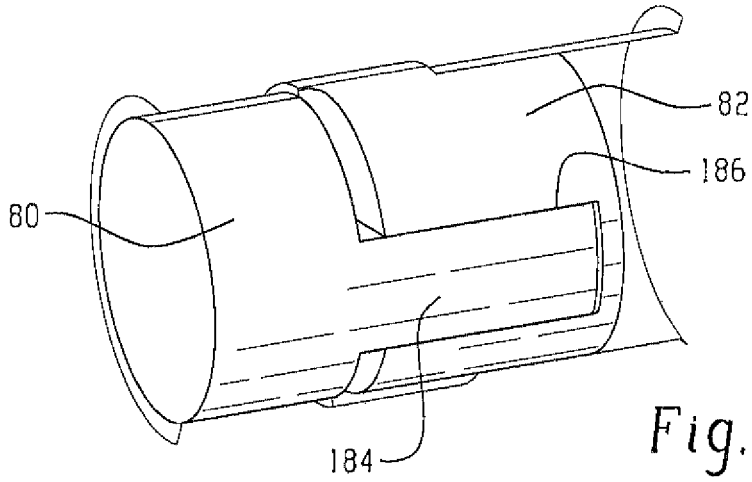
FIGS. 5A, 5B and 5C are schematic perspective views of the synchronizing pin of FIG. 3 in various operating states.
Figure 5B:
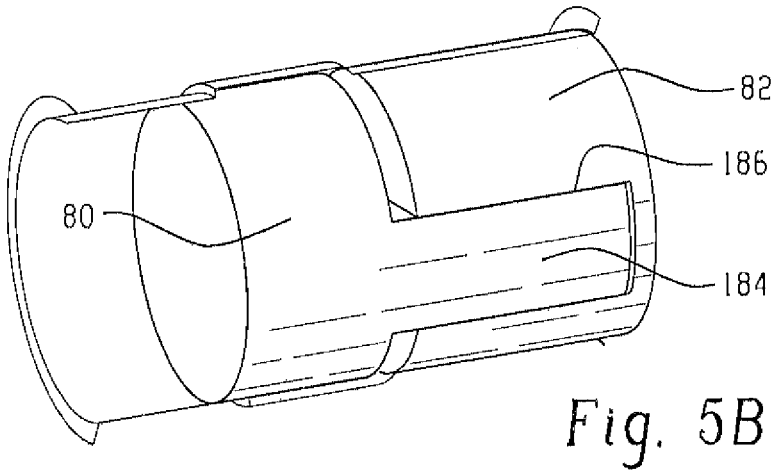
Figure 5C:
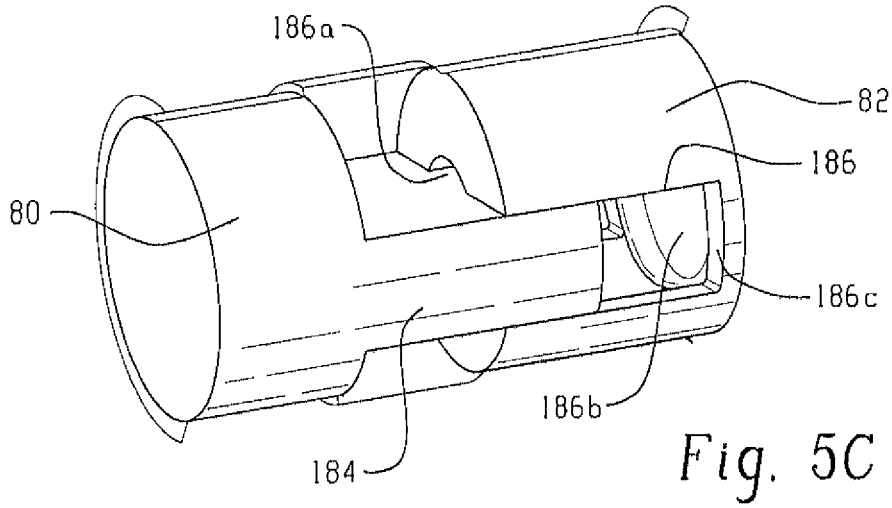

The dual synchronizing pin 40 of the illustrated embodiment includes a first dual pin member 80 adjacent the first auxiliary pin 50 and a second dual pin member 82 adjacent the second auxiliary pin 52. Both the first and second dual pin members 80, 82 are movably disposed within the bore 42 defined in the rocker arms 14, 18, 20 such that the dual pin members 80, 82 are both axially movable relative to one another. The first and second dual pin members 80, 82 each have respective outer axial faces 80*a*, 82*a* facing respective bore axial ends 64, 68 and inner axial faces 80*b*, 82*b* facing one another. The first and second dual pin members 80, 82 collapse toward one another when hydraulic fluid is forced into the first portion 54 to allow movement of the first auxiliary pin 50 into the third portion 58 and when the hydraulic fluid is forced into the second portion 56 to allow movement of the second auxiliary pin 52 into the third portion 58. The pressure source 60 can force hydraulic fluid into the third portion 58 via a fluid passageway 84, and particularly between the first and second dual pin members 80, 82 to force apart the first and second dual pin members 80, 82 from one another to expand an axial length of the dual synchronizing pin 40 and change the dual synchronizing pin assembly 38 and pin 40 into the third state (FIG. 4C). In particular, hydraulic fluid forced through the fluid passageway 84 is directed between the inner axial faces 80*b*, 82*b* of the first and second dual pin members 80, 82 to move the first and second dual pin members axially apart from one another.

Accordingly, the first and second dual pin members 80, 82 collapse toward one another when the synchronizing pin 40 is in either of the first and second states (FIGS. 4A, 5A and 4B, 5B) and move away from one another when the synchronizing pin 40 is in the third state (FIGS. 4C, 5C) to prevent transfer of the pivotal movement from either of the first and second rocker adjacent arms 18, 20 to the central rocker arm 14. As shown, the fluid passageway 84 can specifically direct hydraulic fluid from the hydraulic pressure source 60 into a circumferential groove 86 defined in the central rocker arm 14 about the portion 58. Advantageously, the circumferential groove 86 eliminates or reduces the likelihood of burrs adversely impacting an exterior circumferential surface of the dual synchronizing pin 40, such as might occur with a fluid aperture connected passageway, such as passageway 84, to the portion 58 between the first and second dual pin members 80, 82.

In the illustrated embodiment, the first and second dual pin members 80, 82 are configured or arranged in a key and slot arrangement. In particular, the pin member 80 includes a keyed portion 184 received within a slot 186 defined by the pin member 82. Engagement between the keyed portion 184 and the slot 186 guides axial movement of the pin members 80, 82 relative to one another. As shown, the first and second dual pin members 80, 82 are radially interlocked or meshed with one another due to receipt of the keyed portion 184 within the slot 186. Also, by this arrangement, no axial gap occurs between a distal edge 184*a* of the keyed portion 184 of the first dual pin member 80 and the inner axial face 82*b* of the second dual pin member 82 when the dual pin 40 is in the expanded state of FIG. 40.

With specific reference to FIGS. 4A-C and 5C, a fluid passage can be provided to distribute hydraulic fluid within the portion 58. In the illustrated embodiment, the fluid passage is formed by grooves or ditches 186*a* formed in the keyed portion 184 of the pin member 82 and a concave recess 186*b* formed into an inner face 186*c* of the pin member 82 (i.e., a face defined at the base of the slot 186 as best shown in FIG. 50). By this arrangement, the fluid passage 186*a*, 186*b* forms a gap around the keyed portion 184 that is present even when the keyed portion 184 is fully received in the slot 186. This is due in part to the distal end 184*a* be limited axially by the inner face 186*c*. While the illustrated embodiment shows the fluid passage defined only in the pin member 82, it is to be appreciated that the fluid passage could be defined only in the pin member 80 or in both pin members 80, 82.

By the valve control apparatus 10 described herein, many engine setups are possible. In particular, the valve control apparatus 10 having three rocker arms 14, 18, 20 for controlling one or more engine valves 12 can be configured to control the engine valve 12 to have a variety of opening and closing patterns, which are based on the profiles of the cams 24, 26, 28 corresponding to the rocker arms 14, 18, 20. More particularly, with additional reference to FIG. 6, a first engine set up or type 110 employs the first adjacent rocker arm 18 as a low RPM rocker, the second adjacent rocker arm 20 as a high RPM rocker, and the mid or central rocker arm 14 as being off or idle. In this set up 110, the first cam profile of the first cam 24, which corresponds to the first adjacent rocker arm 18, is configured to optimize performance of the engine during at least one of engine starting and low RPM operation of the engine. Similarly, the second cam profile of the second cam 26, which corresponds to the second adjacent rocker arm 20, is configured to optimize performance of the engine during high RPM operation of the engine. The central rocker arm 14 does not need to have a cam (e.g., cam 28) disposed on the cam shaft 22. Instead, the central rocker arm 14 can remain idle.

In the engine set up 110, the first state, in which pivotal movement of the first adjacent rocker arm 18 is transferred to the central rocker arm 14, can drive the engine valve 12 according to the low RPM cam profile of the first cam 24 associated with the first adjacent rocker arm 18. The second state, in which pivotal movement of the second adjacent rocker arm 20 is transferred to the central rocker arm 14, causes the central rocker arm 14 to move according to the cam profile of the second cam 26, which is aligned with the second adjacent rocker arm 20. The third state, wherein no pivotal movement is transferred from either the first adjacent rocker arm 18 or the second adjacent rocker arm 20 to the central rocker arm 14, can be an idle state wherein no rotation of the cam shaft 22 is transferred into pivoting movement of the central rocker arm 14 such that no linear movement is imparted to the engine valve 12. By this arrangement, the first and second states can provide custom tailored valve timing for different RPM regions of engine operation.

In an alternative second engine set up or type 112, the first adjacent rocker arm 18 is a late close rocker, the center rocker arm 14 is a low RPM rocker and the second adjacent rocker arm 20 is a high RPM rocker. Accordingly, in the set up 112, the second cam 26 has a high RPM cam profile for pivoting the second adjacent rocker arm 20, the third cam 28 has a low RPM profile for pivoting the central rocker arm 14, and the first cam 24 has a late close cam profile for imparting a late closing motion to the first adjacent rocker arm 18. In the set up 112, when neither of the rocker arms 18, 20 are connected by the synchronizing pin 40 to the central rocker arm 14, the central rocker arm 14 operates according to the low RPM cam profile of the third cam 28. When the second adjacent rocker arm 20 is connected by the synchronizing pin 40 to the central rocker 14, the central rocker arm 14 and thus the engine valve 12 move according to the high RPM profile of the second cam 26. When the first adjacent rocker arm 18 is connected by the synchronizing pin 40 to the central rocker arm 14, the central rocker arm 14 and thus the engine valve 12 operate according to both the low RPM cam profile of the third cam 28 and the late close cam profile of the first cam 24. By this example, it should be appreciated that the central rocker arm 14 and the engine valve 12 can be moved according to combined cam profiles, such as low RPM cam profile of the third cam 28 and late close cam profile of the first cam 24 in the engine set up 112.

In yet another example, a third engine set up or type 114 employs the first adjacent rocker arm 18 as a low RPM rocker, the central rocker arm 14 as an early close rocker and the second adjacent rocker arm 20 as a high RPM rocker. Again, the respective cam profiles of cams 24, 26, 28 are configured to provide the appropriate pivoting motion to the rocker arms 14, 18, 20 and ultimately to the engine valve 12.

In operation, the synchronizing pin assembly 38 and pin 40 are movable among three positions corresponding to the first, second and third states. In particular, with reference again to FIG. 3, moving the synchronizing pin 40 to its maximum axial length, which corresponds to the pin 40 being in the third state (FIGS. 4C and 7C), is done by directing pressurized hydraulic fluid from the hydraulic pressure source 60 to the internal area 58 of the pin 40 between the pin members 80, 82. The hydraulic fluid expands the pin 40 until its maximum axial length is reached. As shown in FIGS. 4A-4C, the maximum axial length is limited by the position of the adjacent auxiliary pins 50, 52 in the first and second adjacent rocker arms 18, 20. The auxiliary pins 50, 52 and their respective bore portions 54, 56 defined in the rocker arms 18, 20 are dimensioned such that when the dual pin 40 is fully pressurized, the plane on which it contacts the outer auxiliary pins 50, 52 is free of any rocker arm housings (e.g., rocker arms 18 or 20) allowing the rocker arms 14, 18, 20 to operate independently. In contrast, the collapsed axial length of the dual pin 40 is shorter than the width of the rocker arm 14 and the third portion 58 of the bore 42. Accordingly, when the pressurized hydraulic fluid from the pressurized hydraulic pressure source 60 is directed along passageway 62 to the first portion 54 between the auxiliary pin 50 and the end face 64, the auxiliary pin 50 can move into the third portion 58 and move the dual synchronizing pin 40 to a position wherein an outer face 88 of the pin 40 is flush with a plane dividing the central rocker arms 14 and the second adjacent rocker arm 20 (FIGS. 4A and 7A). Likewise, when pressurized hydraulic fluid is directed into the second portion 56 between the auxiliary pin 52 and the end face 68, the auxiliary pin 52 can move into the third portion 58 and the collapsed dual synchronizing pin 40 can move such that its outer face 88 is flush with a plane dividing the central rocker arm 14 and the first adjacent rocker arm 18 (FIGS. 4B and 7B).

With reference back to FIGS. 3 and 4A-4C, the method for synchronizing rocker arms of an engine valve in an internal combustion engine will now be described. In the method, the central rocker arm 14 flanked by two adjacent rocker arms 18, 20 is provided for imparting linear movement to the engine valve 12. The engine valve 12 is moved according to pivotal movement of the central rocker arm 14. Pivotal movement from one of the adjacent rocker arms (e.g., rocker arm 18 or 20) is selectively transferred to the central rocker arm 14 through synchronizing pin 40. Pivotal movement from the other of the adjacent rocker arms 18, 20 is selectively transferred to the central rocker arm 14 through the same synchronizing pin 40.

Figures 6, 7:
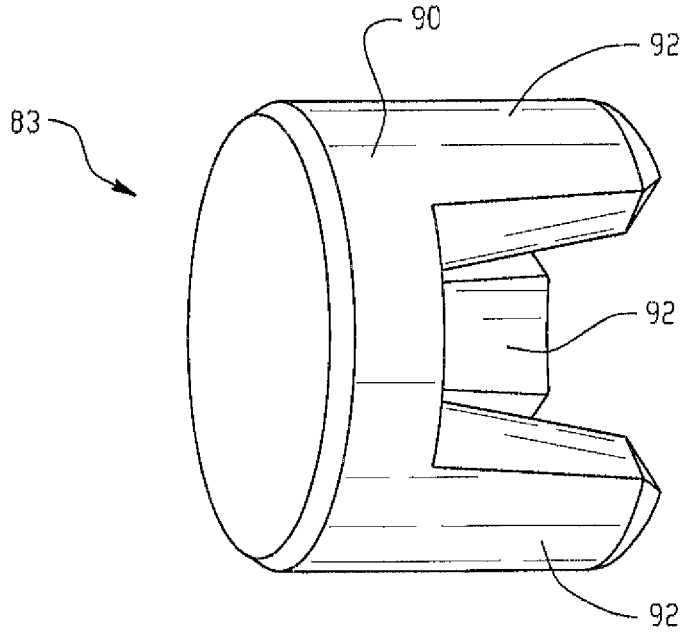
FIG. 6 is an exemplary cam matrix showing various cam combinations for the rocker arms.
FIG. 7 is a perspective view of one sub-pin of a synchronizing pin according to an alternate embodiment of FIG. 3.

FIG. 7 illustrates a pin member 83 that could be used in substitution of each of the pin members 80, 82 (i.e., the key and slot arrangement) according to an alternate exemplary embodiment. The pin member 83 includes a base portion 90 having a plurality of circumferentially spaced apart legs 92 (e.g., three legs in FIG. 7). When two such pin members 83 are used, the legs 92 of each pin member would extend toward the other pin member. Like the key and slot arrangement, the two pin members 83 would be radially interlocked or meshed with one another via the legs 92. Of course, while the pin member 83 is shown having three evenly spaced legs 92, it is to be appreciated that any number of legs could be used and the legs need not be evenly spaced and/or sized.

FIGS. 8A-8C, 9A-9C and 10A-10C illustrate a plurality of dual synchronizing pins according to alternate exemplary embodiments, including showing the alternate pins in each of the first state (i.e., mode A), the second state (i.e., mode C), and the third state (i.e., mode B).

Figure 8A:
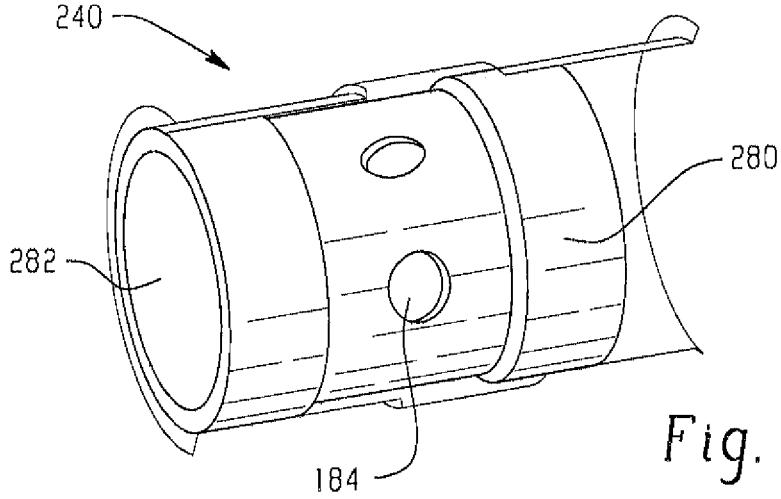
FIGS. 8A, 8B and 8C are schematic perspective views showing a synchronizing pin according to an alternate embodiment in various operating positions.
Figure 8B:
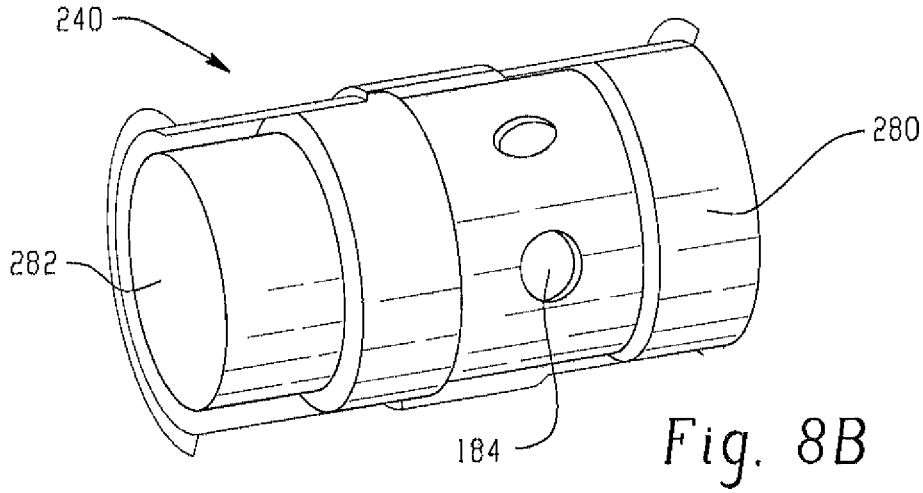
Figure 8C:
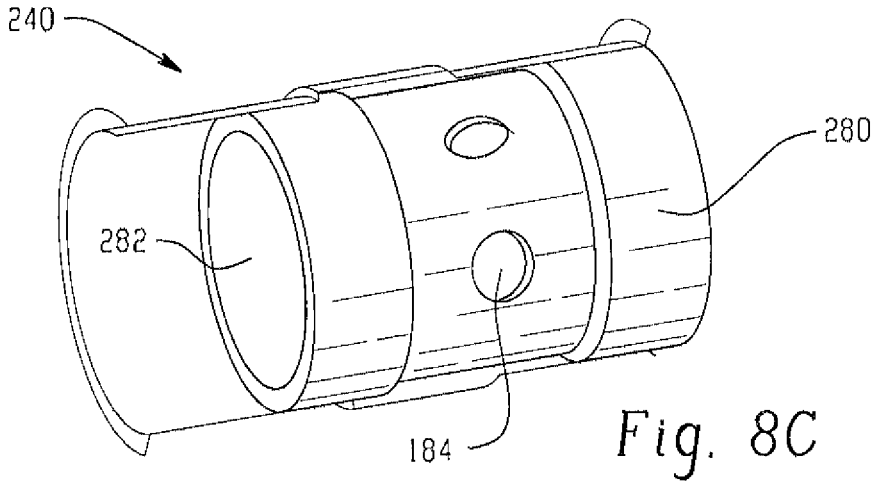
Figure 9A:
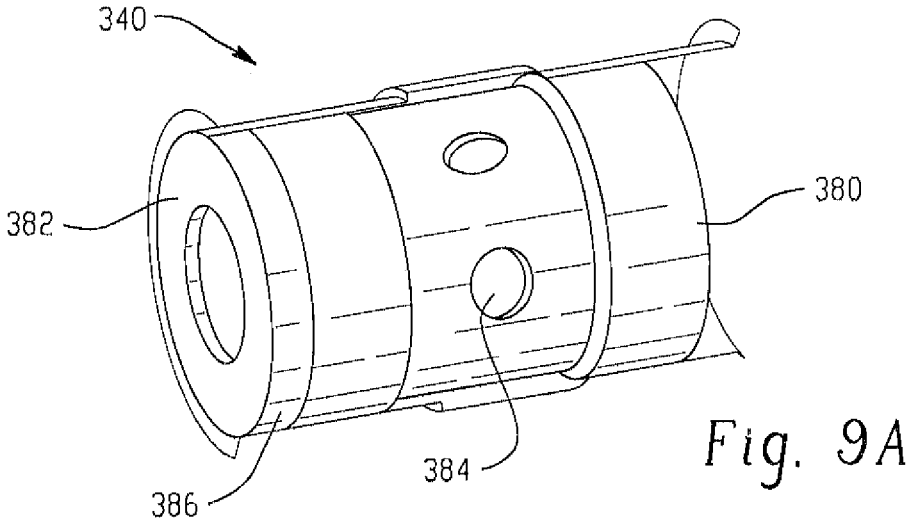
FIGS. 9A, 9B and 9C are schematic perspective views showing a synchronizing pin according to another alternate embodiment in various operating positions.
Figure 9B:
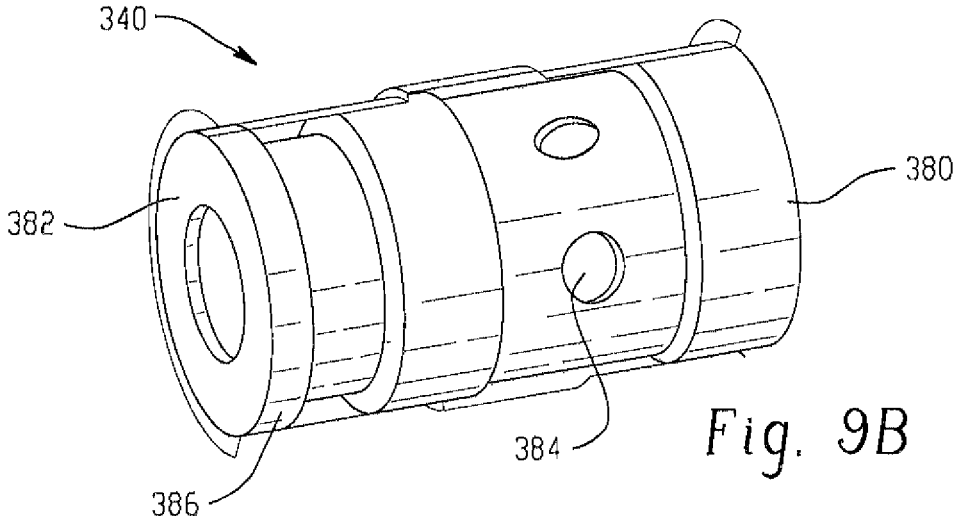
Figure 9C:
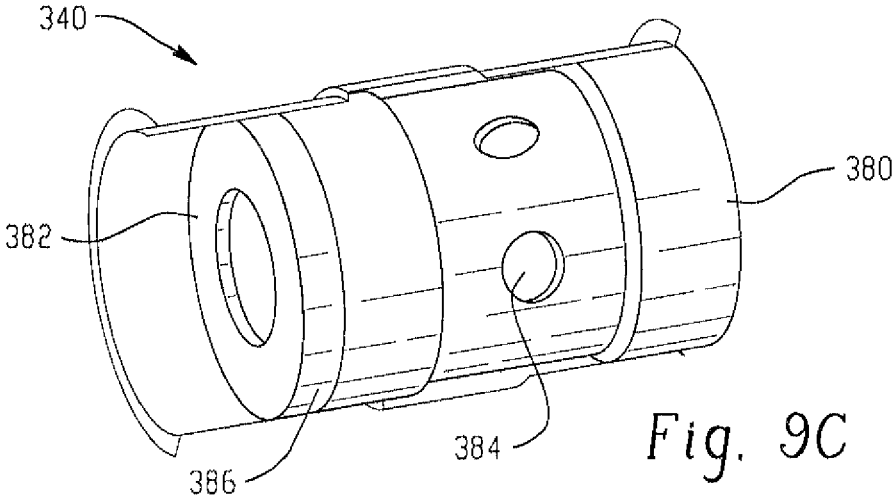
Figure 10A:
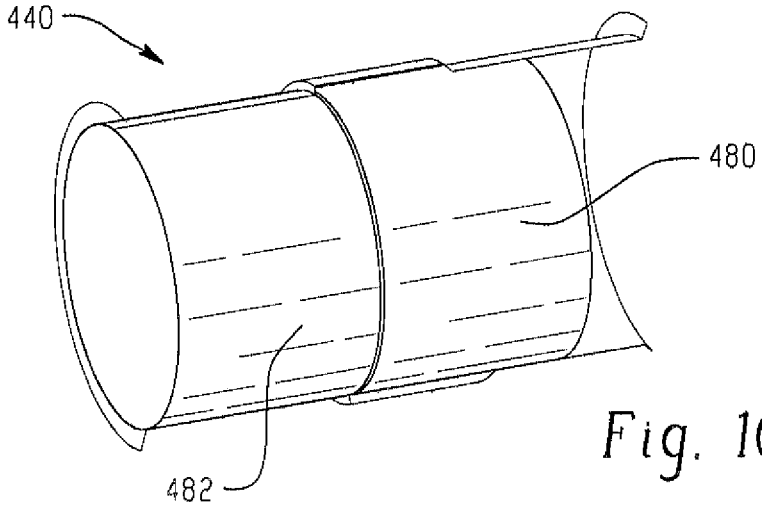
FIGS. 10A, 10B and 10C are schematic perspective views showing a synchronizing pin according to still another alternate embodiment in various operating positions.
Figure 10B:
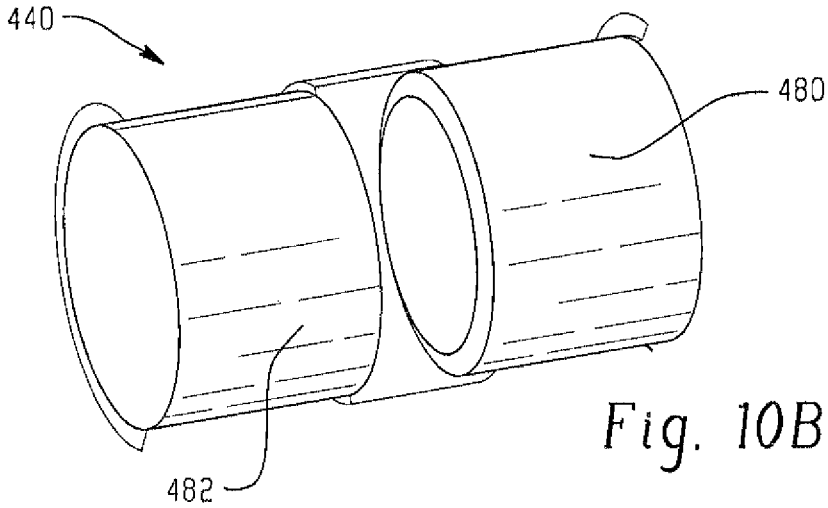
Figure 10C:
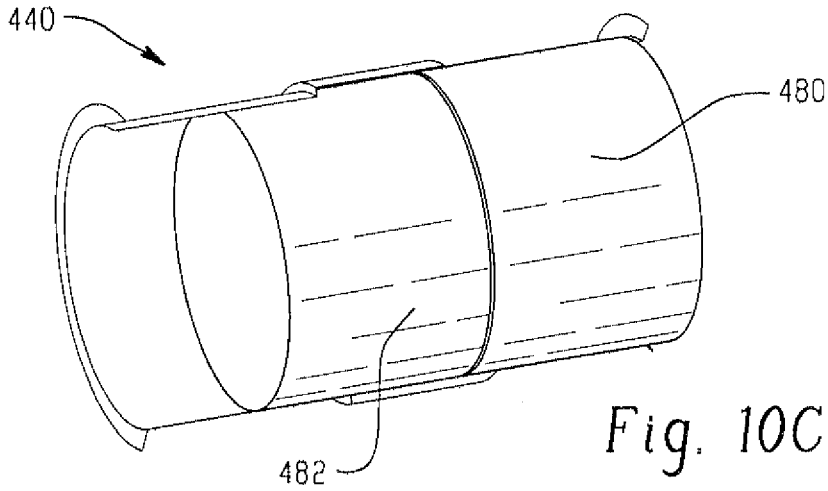

With reference to FIGS. 8A-8C, an alternate dual synchronizing pin 240 is shown wherein the pin members 80, 82 are replaced by concentric telescoping pin members 280, 282. More particularly, the telescoping pin member 280 forms an outer sleeve in which an inner pin member 282 is telescopingly received. Apertures 284 are defined in the outer pin member 280 for allowing hydraulic fluid to be directed axially between the pin members 280, 282 for expanding the pin 240 as shown in FIG. 8*b*. FIGS. 9A-9C show another dual pin 340 having a telescoping arrangement wherein pin members 80, 82 are replaced by telescoping pin members 380, 382. The dual pin 340 of FIGS. 9A-9C is similar to the dual pin of FIGS. 8*a*-8*c* except that the telescoping pin member 382 includes an outer radial or step flange 386. FIGS. 10A-10C illustrate yet another alternate synchronizing pin 440 comprising two separate identical pins members 480, 482. The pin members 480, 482 of synchronizing pin 440 function similarly to the pin members of synchronizing pins 40, 140, 240 and 340, except that there is no overlapping between the pins 480, 482.

Figure 11:
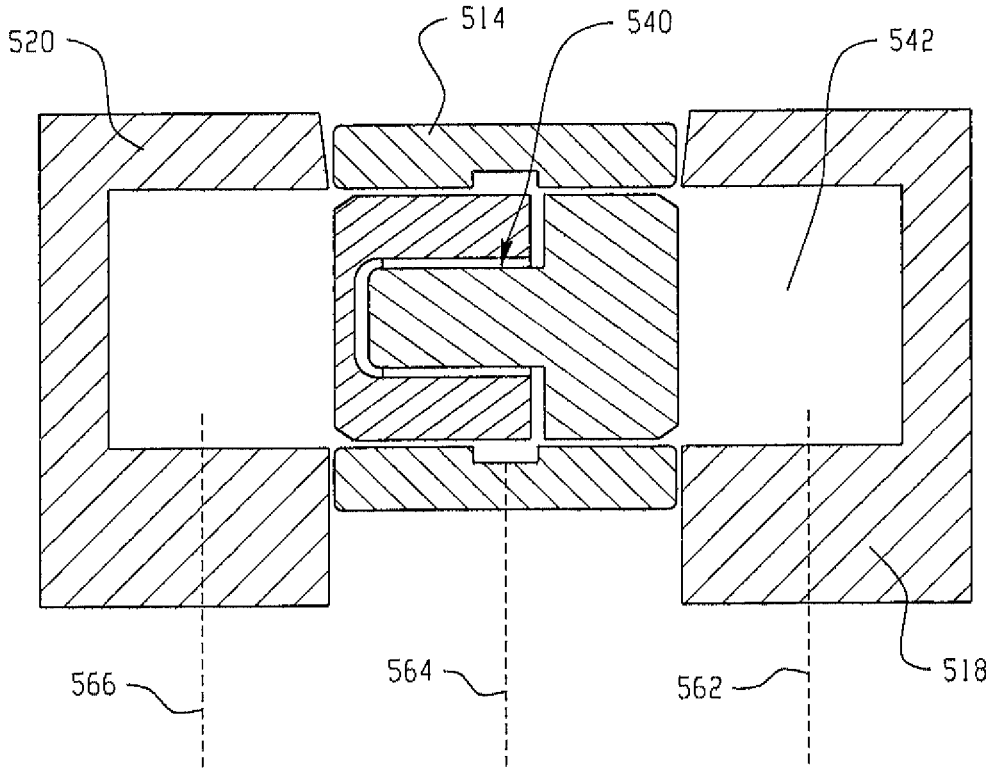
FIG. 11 is a schematic view of a synchronizing pin according to still yet another alternate embodiment.

With reference to FIG. 11, a dual synchronizing pin 540 is shown according to still another alternate embodiment for movement within a bore 542 defined in a central rocker arm 514, first adjacent rocker arm 518 and second adjacent rocker arm 520. The dual synchronizing pin 540 operates similarly to the dual synchronizing pin 40 except that its minimum axial length when it is in its collapsed state is the same as the width of the central rocker arm 514. Accordingly, when the dual synchronizing pin 540 moves to its expanded position, it is able to exceed the width of the central rocker arm 514 thereby allowing the synchronizing pin 540 to enter one of the first adjacent rocker arm 518 or the second adjacent rocker arm 520. Controlling movement of the dual synchronizing pin 540 when in its expanded axial state can occur by directing hydraulic fluid via schematically illustrated lines 562, 564, 556. If desired for the dual synchronizing pin 540 to enter the first adjacent rocker arm 518, pressurized hydraulic fluid can be directed through lines 564 and/or 566 to ensure movement of the expanded synchronizing pin 540 into the first adjacent rocker arm 518. Similarly, when desirable to move the synchronizing pin 540 into the second adjacent rocker arm 520, pressurized hydraulic fluid can be directed through lines 562 and/or 554 to ensure movement of the synchronizing pin 540 in its expanded position into the second adjacent rocker arm 520.

Figure 12:
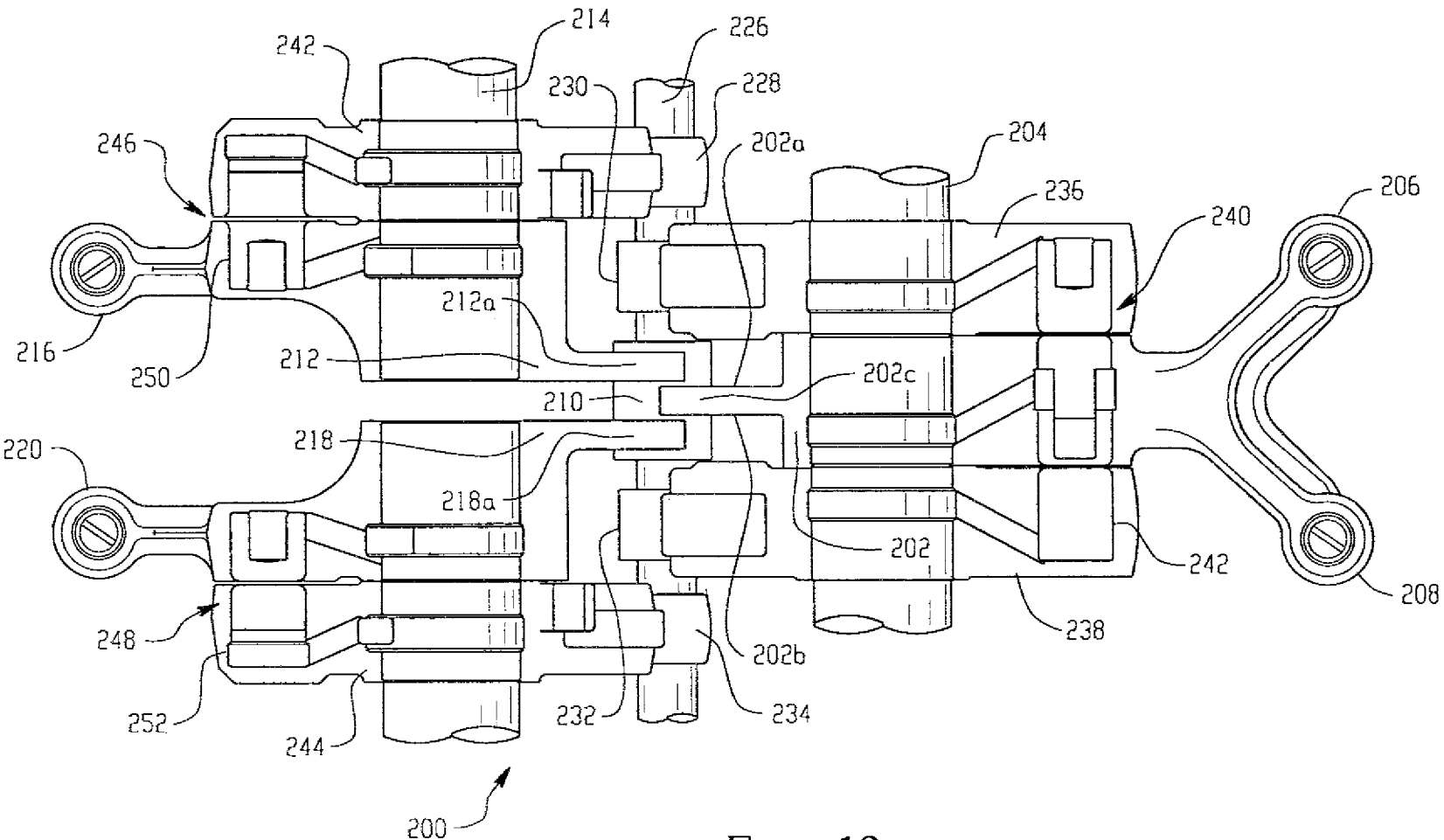
FIG. 12 is a schematic view of a valve operating apparatus according to an alternate embodiment.

With reference to FIG. 12, a valve control apparatus 200 for an internal combustion engine is shown according to an alternate embodiment for controlling engine valve opening and closing operations. The control apparatus 200 includes a central rocker arm 202 pivotally supported on a rocker shaft 204 for imparting linear movement to at least one first engine valve (e.g., engine valves 206, 208 in the illustrated embodiment). Movement of the central rocker arm 202 can be directed by cam 210 having a cam surface or profile defined thereon. In particular, in the illustrated embodiment, pivoting movement of the central rocker arm 202 imparts linear movement to the engine valves 206 and 208 for opening and closing thereof.

A first rocker arm 212 is pivotally supported on another rocker shaft 214 adjacent a first side 202*a* of the central rocker arm 202 for imparting linear movement to at least one second engine valve (e.g., engine valve 216 in the illustrated embodiment). Movement of the first rocker arm 212 is also directed by the cam 210 having the cam surface (i.e., the same cam 210 that directs movement of the central rocker arm 202). In particular, in the illustrated embodiment, pivoting movement of the rocker arm 212 imparts linear movement to the engine valve 216 for opening and closing thereof.

A second rocker arm 218 is pivotally supported on the rocker shaft 214 adjacent a second, opposite side 202*b* of the central rocker arm 202 for imparting linear movement to at least one third engine valve (e.g., engine valve 220 in the illustrated embodiment). Movement of the second rocker arm 218 is directed by the cam 210 having the cam surface (i.e., the same cam that directs movement of the central rocker arm 202 and the first rocker arm 212). In particular, in the illustrated embodiment, pivoting movement of the rocker arm 218 imparts linear movement to the engine valve 220 for opening and closing thereof.

The at least one first engine valve, which has linear movement imparted thereto by the central rocker arm 202, can be one or more intake valves or one or more exhaust valves, and the at least one second and at least one third engine valves, which have, respectively, linear movement imparted thereto by the first and second rocker arms 212, 218, can be the other of the one or more intake valves or the one or more exhaust valves. In particular, as shown in the illustrated embodiment, the at least one first engine valve is at least two engine valves, particularly engine valves 206 and 208, the at least one second engine valve is a single engine valve (i.e., engine valve 216) and the at least one third engine valve is a single engine valve (i.e., engine valve 218). It is to be appreciated by those skilled in the art that other numbers of engine valves could be used for each of the at least one first, second and third engine valves than those depicted in the illustrated embodiment. Also in the illustrated embodiment, the engine valves 206, 208 are the intake valves and the engine valves 216, 220 are the exhaust valves, though this is not required.

The apparatus 200 further includes a cam shaft 226, which can operate in the same manner as described in reference to the cam shaft 22 hereinabove. The cam 210 can be disposed on the cam shaft 226 so as to be rotatably driven in synchronism with rotation of the engine via rotation of the cam shaft 226. As will be described in more detail below, additional cams (e.g., cams 228, 230, 232, 234) can be disposed on the cam shaft 226 so as to also be rotatably driven in synchronism with rotation of the engine when the cam shaft 226 is rotated. These additional cams 228-234 can have cam surfaces or profiles that vary from the cam surface or profile of the cam 210 and/or from one another.

Through the apparatus 200, movement of each of the central rocker arm 202, the first rocker arm 212 and the second rocker arm 218 can advantageously be directed by a single cam, such as the cam 210. In addition (as shown in the illustrated embodiment), the central rocker arm 202, and particularly a cam follower portion 202*c* thereof, can be arranged in nested, closely spaced relation between the first and second rocker arms 212, 218, and particularly cam follower portions 212*a* and 218*a*. The close spacing of the three cam followers 202*c*, 212*a*, 218*a* provides for contact between one cam surface or profile (i.e., the cam surface of the cam 210) and all three of the cam followers 202*c*, 212*a*, 218*a*.

In the illustrated embodiment, additional cams and rocker arms are provided for operating the valves 206, 208 and 216, 220, though this is not required. In particular, rocker arms 236, 238 can flank the central rocker arm 202 and assist in operating opening and closing operations of the valves 206, 208. The rocker arm 236 is aligned with and driven by the cam 230 and the rocker arm 238 is aligned with and driven by the cam 232. The cams 230 and 232 can have cam surfaces or profiles that vary relative to each other and/or that of cam 210.

A synchronizing pin assembly 240 can be included in the illustrated valve control apparatus 200 for selectively transferring pivoting movement of one or both of the rocker arms 236, 238 to the central rocker arm 202. The synchronizing pin assembly 240 is received in a bore 242 defined through the central rocker arm 202 and at least partially into each of the rocker arms 236, 238. The synchronizing pin assembly 240 selectively bridges between the rocker arm 236 and the central rocker arm 202 to transfer pivoting movement from the rocker arm 236 to the central rocker arm 202, and selectively bridges between the rocker arm 238 and the central rocker arm 202 to transfer pivoting movement from the rocker arm 238 to the central rocker arm 202. The synchronizing pin assembly 240 can be the same or similar to one of those already described herein (e.g., synchronizing pin assembly 40) and thus will not be described in further detail.

Flanking the rocker arms 212, 218, in the illustrated embodiment, are rocker arms 242 and 244. The rocker arm 242 is aligned with and driven by the cam 228. The rocker arm 244 is aligned with and driven by the cam 234. Synchronizing pin assemblies 246, 248 are provided, respectively, in association with the rocker arms 242 and 244 for selectively transferring pivoting movement from the rocker arm 242 to the rocker arm 212 and/or from the rocker arm 244 to the rocker arm 218. The cams 228 and 234 can have cam surfaces and profiles that are the same as or vary from one another, and/or that vary from that of the cam 210, though this is not required.

The synchronizing pin assembly 246 is received in a bore 250 defined at least partially into each of the rocker arms 212, 242. The synchronizing pin assembly 246 selectively bridges between the rocker arm 242 and the rocker arm 212 to transfer pivoting movement of the rocker arm 242 to the rocker arm 212. The synchronizing pin assembly 248 is received in a bore 252 defined at feast partially into each of the rocker arms 218 and 244. The synchronizing pin assembly 248 selectively bridges between the rocker arms 244 and 218 to transfer pivoting movement from the rocker arm 244 to the rocker arm 218. When such pivoting movement is transferred to either or both of the rocker arms 212, 218, operation of the respective valves 218, 220 is then driven by the corresponding cams 228 and/or 234. The synchronizing pin assemblies 246, 248 can be similar to the synchronizing pin assembly 240, though simplified since only two rocker arms are selectively connected to one another as will be understood and appreciated by those skilled in the art.

It will be appreciated that various of the above-disclosed and other features and functions, or alternatives or varieties thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A valve control apparatus for an internal combustion engine for controlling opening and closing operations of an engine valve, the valve control apparatus comprising:

a central rocker arm pivotally supported on a rocker shaft, pivoting movement of said central rocker arm imparting linear movement to the engine valve for opening and closing the engine valve;

a first adjacent rocker arm pivotally supported on said rocker shaft on a first side of said central rocker arm;

a second adjacent rocker arm pivotally supported on said rocker shaft on a second, opposite side of said central rocker arm;

a plurality of cams rotatably driven in synchronism with rotation of the engine, said plurality of cams including:

a first cam arranged to pivotally move said first adjacent rocker arm about said rocker shaft according to a first cam profile of said first cam, and a second cam arranged to pivotally move said second adjacent rocker arm about said rocker shaft according to a second cam profile of said second cam;

a dual synchronizing pin for selectively synchronizing pivoting movement of said central rocker arm to at least one of said first adjacent rocker arm and said second adjacent rocker arm, said dual synchronizing pin having a first state wherein pivotal movement of said first adjacent rocker arm, which corresponds to said first cam, is transferred to said central rocker arm, a second state wherein pivotal movement of said second adjacent rocker arm, which corresponds to said second cam, is transferred to said central rocker arm, and a third state wherein no pivotal movement is transferred from either said first adjacent rocker arm or said second adjacent rocker arm; and a first auxiliary pin operably associated with said first rocker arm and a second auxiliary pin operably associated with said second rocker arm, said dual synchronizing pin being disposed between and axially aligned with said first and second auxiliary pins.

2. The valve control apparatus of claim 1 further including:

a cam shaft having said first and second cams disposed thereon, said cam shaft rotatably driven by the engine to rotate said first and second cams in synchronism with the engine, respective engagement between said first and second cams and said first and second adjacent rocker arms transferring rotational movement of said cam shaft into pivoting movement of said first and second rocker arms.

3. The valve control apparatus of claim 1 wherein said third state is an idle state wherein no rotation of said cam shaft is transferred into pivoting movement of said central rocker arm such that no linear movement is imparted to the engine valve.

4. The valve control apparatus of claim 1 wherein said second cam profile is configured to optimize performance of the engine during high RPM operation of the engine.

5. The valve control apparatus of claim 4 wherein said first cam profile is configured to optimize performance of the engine during at least one of engine starting and low RPM operation of the engine.

6. The valve control apparatus of claim 1 wherein said plurality of cams further includes:

a third cam arranged to pivotally move said central rocker arm about said rocker shaft according to a third cam profile of said third cam when said synchronizing device is in said third state.

7. The valve control apparatus of claim 6 wherein movement of said central rocker arm corresponds to at least one of said first cam profile and said third cam profile when said synchronizing pin is in said first state and corresponds to at least one of said second cam profile and said third cam profile when said synchronizing pin is in said second state.

8. The valve control apparatus of claim 1 wherein said dual synchronizing pin is movably disposed within a bore defined in said central, first and second rocker arms for selectively connecting said central rocker arm to either said first adjacent rocker arm or said second adjacent rocker arm.

9. The valve control apparatus of claim 8 wherein said dual synchronizing pin has an adjustable axial length.

10. The valve control apparatus of claim 8 wherein said bore has an axis oriented generally parallel to said rocker shaft and movement of said synchronizing pin within said bore occurs along said axis to selectively connect said central rocker arm to either of said first adjacent rocker arm for synchronized pivotal movement therewith or said second adjacent rocker arm for synchronized pivotal movement therewith.

11. The valve control apparatus of claim 8 wherein:

said first auxiliary pin received within a first portion of said bore defined in said first rocker arm, wherein said first auxiliary pin is movable between an actuated position wherein said first auxiliary pin is received in said first portion and a third portion of said bore defined in said central rocker arm to synchronize movement of said first rocker arm and said central rocker arm with one another and a nonactuated position wherein said first auxiliary pin is received in said first portion but removed from said third portion; and said second auxiliary pin received within a second portion of said bore defined in said second rocker arm, wherein said second rocker arm pin is movable between an actuated position wherein said second auxiliary pin is received in said second portion and said third portion to synchronize movement of said second rocker arm and said central rocker arm with one another and a nonactuated position wherein said second auxiliary pin is received in said second portion but removed from said third portion.

12. The valve control apparatus of claim 11 wherein said dual synchronizing pin is received in said third portion of said bore, which is defined through said central rocker arm, an axial length of said dual synchronizing pin matching an axial length of said third portion when said dual synchronizing pin is in said third state to prevent said first and second auxiliary pins from protruding into said third portion from said first and second portions, said axial length of said dual synchronizing pin less than said axial length of said third portion when said dual synchronizing pin is in said first state to allow said first auxiliary pin to extend into said third portion and when said dual synchronizing pin is in said second state to allow said second auxiliary pin to extend into said third portion.

13. The valve control apparatus of claim 12 wherein pressurized hydraulic fluid selectively moves said first auxiliary pin, said second auxiliary pin and said dual synchronizing pin to change said dual synchronizing pin to one of said first, second and third states, said hydraulic fluid forced into said first portion between said first auxiliary pin and an end face of said first rocker arm defining said first portion to move said first auxiliary pin into said third portion to change said dual synchronizing pin into said first state, and said hydraulic fluid forced into said second portion between said second auxiliary pin and an end face of said second rocker arm defining said second portion to move said second auxiliary pin into said third portion to change said dual synchronizing pin into said second state.

14. The valve control apparatus of claim 13 wherein said dual synchronizing pin includes:

a first dual pin member adjacent said first auxiliary pin; and a second dual pin member adjacent said second auxiliary pin, said first and second dual pin members collapsing toward one another when said hydraulic fluid is forced into said first portion to allow movement of said first auxiliary pin into said third portion and when said hydraulic fluid is forced into said second portion to allow movement of said second auxiliary pin into said third portion, and said hydraulic fluid forced into said third portion between said first and second dual pin members to force apart said first and second dual pin members from one another to expand an axial length of said dual synchronizing pin and change said dual synchronizing pin into said third state.

15. The valve control apparatus of claim 1 wherein said dual synchronizing pin includes:

a first dual pin member and a second dual pin member, both movably disposed within a bore defined in said central, first and second rocker arms, said first and second dual pin members collapsing toward one another when said synchronizing pin is in either of said first and second states and moving away from one another when said synchronizing pin is in said third state to prevent transfer of said pivotal moment from either of said first and second rocker arms to said central rocker arm.

16. The valve control apparatus of claim 15 wherein each of said first and second dual pin members includes a base portion having a plurality of legs, said legs of said first dual pin member extending toward said second dual pin member and said legs of said second dual pin member extending toward said first dual pin member, said legs of said first and second dual pin members radially interlocked with one another.

17. The valve control apparatus of claim 15 wherein one of said first and second dual pin members includes an extending portion telescopingly received in a sleeve portion of the other of said first and second dual pin members.

18. The valve control apparatus of claim 1 wherein said dual synchronizing pin includes:

a first dual pin member and a second dual pin member, both axially movable relative to one another within a bore defined in said central, first and second rocker arms, wherein said first and second dual pin members each have outer axial faces facing respective bore axial ends and inner axial faces facing one another, hydraulic fluid directed between said inner axial faces of said first and second dual pin members to move said first and second dual pin members axially apart from one another.

19. The valve control apparatus of claim 18 wherein said first dual pin member extends into said first rocker arm when said dual synchronizing pin is in said first state, said second dual pin member extends into said second rocker arm when said synchronizing pin is in said second state, and neither said first dual pin member or said second dual pin member extends into said first rocker arm or said second rocker arm when said synchronizing pin is in said third state.

20. A valve control apparatus for an internal combustion engine for controlling engine valve opening and closing operations, comprising:

a central rocker arm pivotally supported for imparting linear movement to at least one engine valve;

a first rocker arm pivotally supported adjacent a first side of said central rocker arm for imparting linear movement to said at least one engine valve via said central rocker arm;

a second rocker arm pivotally supported adjacent a second, opposite side of said central rocker arm for imparting linear movement to said at least one engine valve independent of said first rocker arm and via said central rocker arm; and a synchronizing pin assembly for selectively transferring pivoting movement of one or both of said first rocker arm and said second rocker arm to said central rocker arm, wherein said synchronizing in assembly includes a dual in having an adjustable axial length and having a first dual pin member axially aligned with and selectively connected to a second dual pin member, and further including a pair of auxiliary pins flanking said first and second dual pin members for selectively bridging between said first rocker arm and said central rocker arm, selectively bridging between said second rocker arm and said central rocker arm, and selectively bridging between neither of said first rocker arm and said central rocker arm or said second rocker arm and said central rocker arm.

21. The valve control apparatus of claim 20 wherein movement of said second rocker arm is directed by a second cam having a second cam profile and movement of said first rocker arm is directed by a first cam having a first cam profile, said synchronizing pin assembly received in a bore defined through said central rocker arm and at least partially into each of said first and second rocker arms, said synchronizing pin assembly selectively bridging between said first rocker arm and said central rocker arm to transfer pivoting movement of said first rocker arm to said central rocker arm and selectively bridging between said second rocker arm and said central rocker arm to transfer pivoting movement from said second rocker arm to said central rocker arm.

22. The valve control apparatus of claim 20 wherein movement of each of said central rocker arm, said first rocker arm and said second rocker arm is directed by a single cam.

23. The valve control apparatus of claim 22 wherein a cam follower portion of said central rocker arm is nested in closely spaced relation between cam follower portions of said first and second rocker arms.

24. A method for synchronizing rocker arms of an engine valve in an internal combustion engine, comprising:

providing a central rocker arm flanked by two adjacent rocker arms for imparting linear movement to the engine valve;

moving the engine valve according to pivotal movement of the central rocker arm;

selectively transferring pivotal movement from one of the adjacent rocker arms to the central rocker arm through a synchronizing pin assembly having a dual synchronizing pin having an adjustable axial length;

providing the synchronizing pin assembly in a single axial extending bore defined by a first portion extending at least partially through one rocker arm, a second portion extending at least partially through the other rocker arm and a third portion extending through said central rocker arm; and selectively transferring pivotal movement from the other of the adjacent rocker arms to the central rocker arm through the dual synchronizing pin.

* * * * *